US005186125A

United States Patent [19]

Halyung

[11] Patent Number: 5,186,125

[45] Date of Patent: Feb. 16, 1993

[54] MOBILE CAPTURE AND RESTRAINT DEVICE

[76] Inventor: Warren P. Halyung, Box 69, Robsart, Saskatchewan, Canada, S0N 2G0

[21] Appl. No.: 944,309

[22] Filed: Sep. 14, 1992

[51] Int. Cl.[5] ..... A61D 3/00

[52] U.S. Cl. ..... 119/99

[58] Field of Search ..... 119/96, 98, 99, 15.2

[56] References Cited

U.S. PATENT DOCUMENTS

| | | | |
|---|---|---|---|
| 2,935,966 | 5/1960 | Smith | 119/98 |
| 3,095,858 | 7/1963 | Bauer | 119/96 |
| 3,918,406 | 11/1975 | Patterson | 119/96 |

*Primary Examiner*—Gene Mancene
*Assistant Examiner*—Thomas Price

[57] ABSTRACT

An animal capture and restraint device to be mounted on and to be fully supported by a vehicle. The device has supports which allow for easy mounting on the vehicle. The body of the vehicle is protected by a body guard mounted on the supports with a portion being pivotal to enable full use of the vehicle doors. A main gate is formed of several pivoted members that form an animal capturing area and is pivotally mounted to the vehicle body guard. An arch is also pivoted to the body guard and when in the operational position supports the main gate. The arch is further supported by a guy and tie bar connected to the vehicle frame. At the forward end is a head gate or stanchion to encircle the animals neck to restrain or hold it securely. A first hydraulic cylinder is used to control the movement of the arch and a second hydraulic cylinder is used to control a head gate arm of the head gate to encircle the animals neck. When not in use the head gate, main gate and arch are all pivoted adjacent the vehicle body for normal operation of the vehicle.

21 Claims, 6 Drawing Sheets

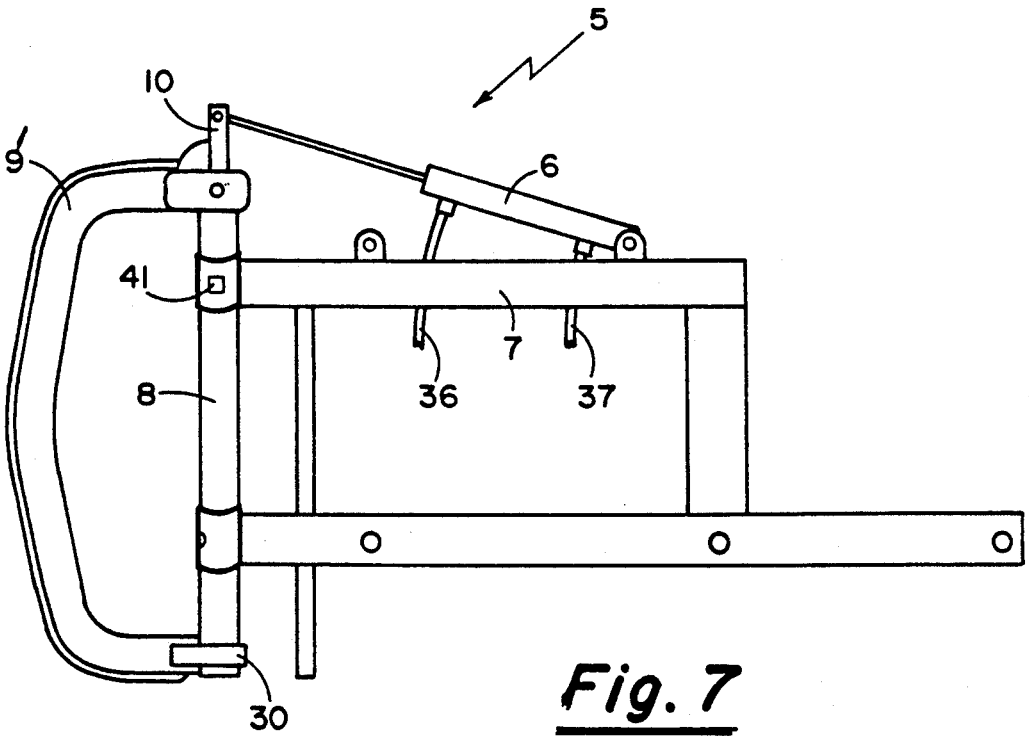
Fig. 7
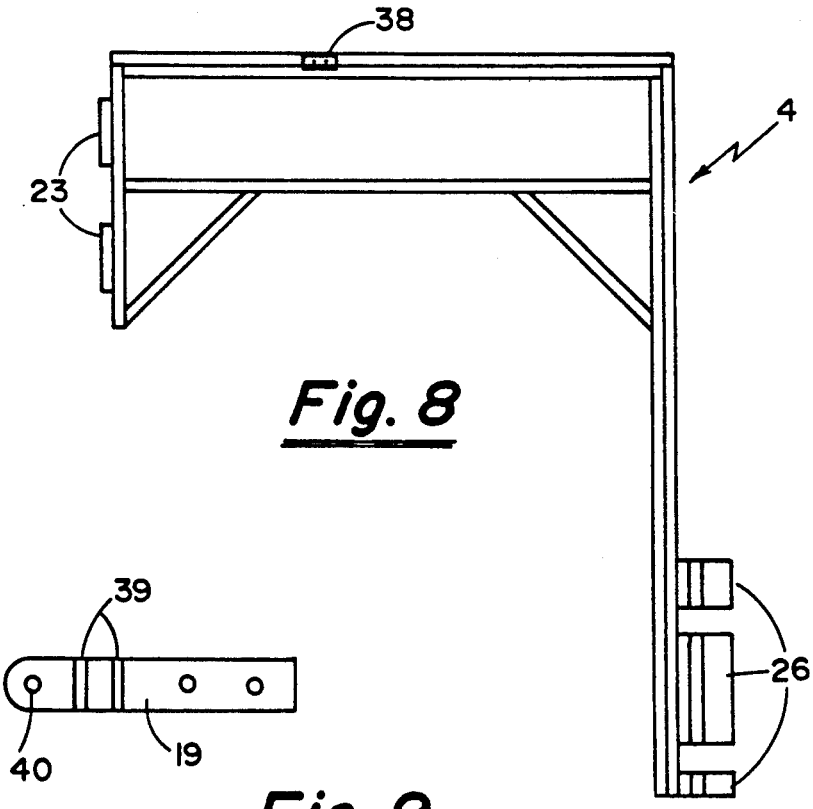
Fig. 8
Fig. 9

MOBILE CAPTURE AND RESTRAINT DEVICE

This application relates generally to a mobile animal handling system and more particularly to a capture and restraint device for cattle or the like.

BACKGROUND OF INVENTION

With the need to become more competitive the cattle industry has like most others attempted to be less costly and in particular less labour intensive. The loss of livestock due to inadequate attention such as during calving can also be devastating especially with range cattle.

To obviate the above problems attempts have been made to provide mobile cattle handling systems, two such attempts being in the form of U.S. Pat. No. 3,095,858 issued 2 Jul. 1963 to Oscar E. Bauer and Canadian patent 1,035,214 issued 25 Jul. 1978 to Herbert F. Hoffman.

U.S. Pat. No. "858" provides a pen formed of pivotally hinged mesh type walls hydraulically actuated to encircle and capture an animal. A restraining device is provided to restrain the animal and support wheels are required as the pen is pushed across the terrain. Applicant's device is more easily and accurately controlled when operational even at high speeds, it is fully supported by the vehicle and is mounted on the side of vehicle for complete utility of the vehicle for normal use especially when the device is in the stored position.

Canadian patent "214" has two hinged frame type walls or gates each hydraulically operated to pivotally force an animal rearwardly onto a floor for transportation. Applicants device has no carrying floor but does have a hydraulically actuated head gate or stanchion, is easily controlled, is mounted on the side of the vehicle, and can be stored in an unobtrusive position.

SUMMARY OF INVENTION

In view of the paucity of devices in the prior art to overcome some of the problems encountered in the ranching industry, and in particular cattle handling, applicant has provided a capture and restraint device that is located on one side of a vehicle and is wholly supported thereby. The device includes vehicle mounting means, body guard means connected to the vehicle mounting means to protect the vehicle body, gate wings pivotally joined and supported by the body guard means to form an animal capturing space therewith and animal restraining means cooperating with the body guard means and connectable to the vehicle frame whereby the fully vehicle supported device can be utilized in the capture and restraint of an animal.

In view of the above summary of applicants device it is readily discernible that the following objects can be achieved.

It is a primary object of applicants invention to provide an efficient and effective mobile cattle handling system.

It is a further object of applicants invention to provide a capture and restraint device that is fully supported by a vehicle along one side thereof to enable full utilization of the vehicle at all times.

It is a further object of applicants invention to provide a capture and restraint device that is fully collapsible along one side of a vehicle while retaining access to the door on the mounting side.

It is yet another object of the present invention to provide a means to assist in calving, branding, dehorning, treatment and the like.

These and other objects of the present invention will become readily apparent as the following description is read in conjunction with the accompanying drawings wherein like reference numerals indicate like elements throughout the several views.

BRIEF DESCRIPTION OF THE DRAWINGS

FIG. 7 is a front elevation view of the head gate assembly.

FIG. 8 is a front elevation of the arch.

FIG. 9 is a plan view of the rear bumper support bracket.

DETAILED DESCRIPTION OF DRAWINGS

Figure 1:
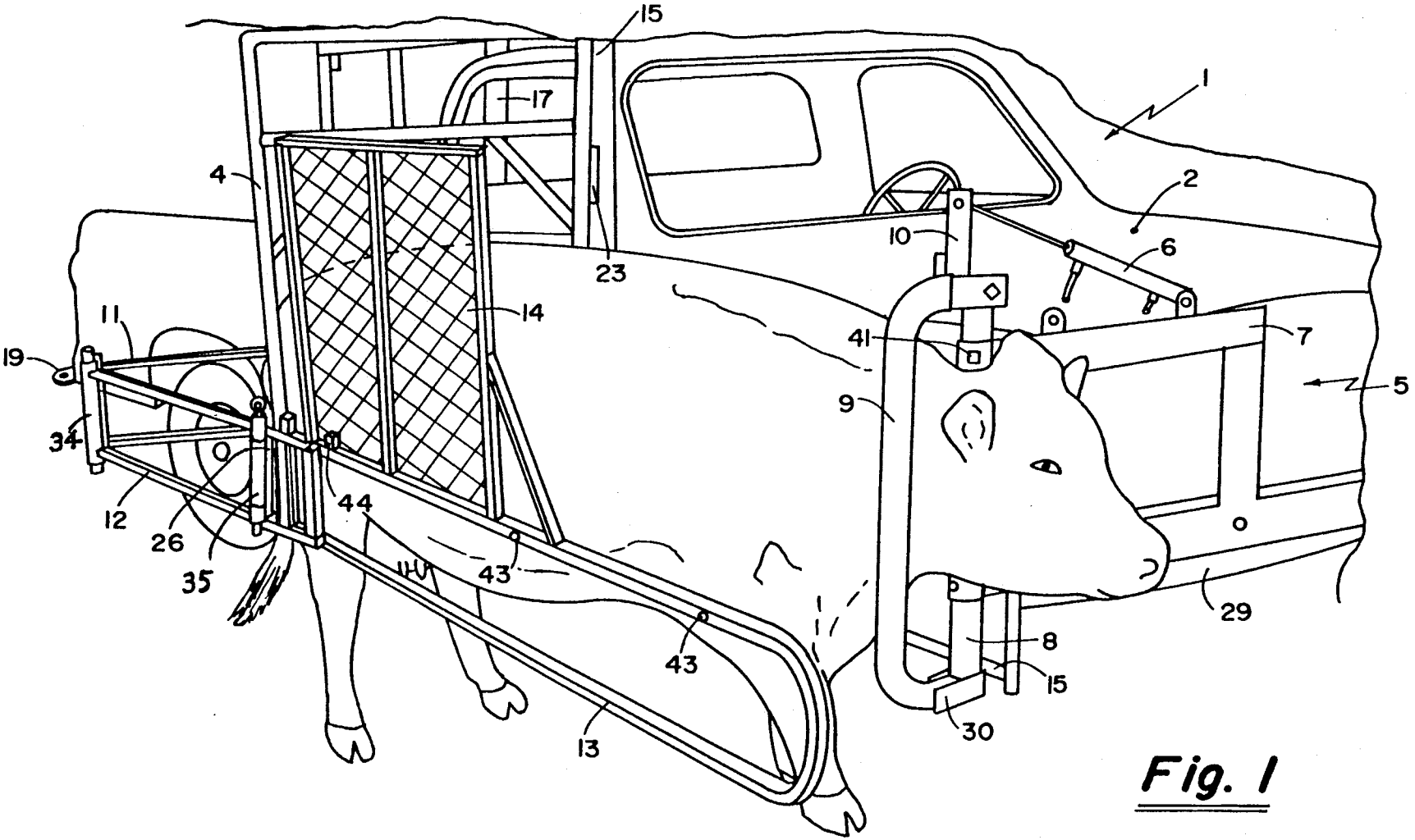
FIG. 1 is a perspective view of the instant invention mounted on a vehicle, restraining a captured animal.
Figure 3:
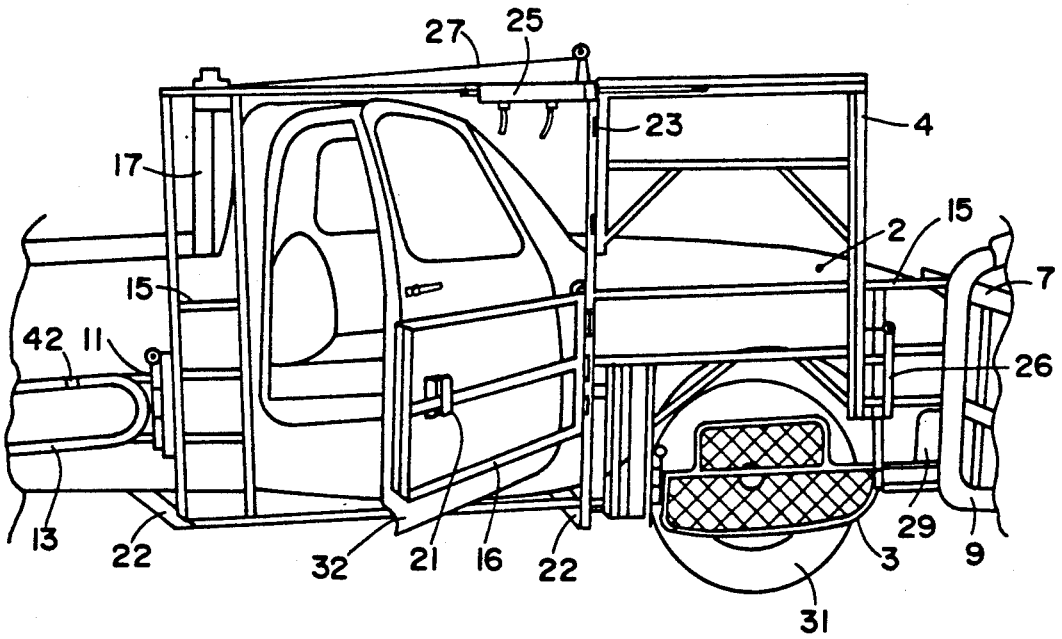
FIG. 3 is a central portion in elevation of the mounted invention in the storage position with the door gate pivoted by normal operation of the vehicle door.

Referring now to the drawings with a detailed description we have in FIG. 1 the instant invention mounted on a vehicle 1 with an animal in the captured and restrained position wherein there is a vehicle body protector or guard means comprised mainly of a guard frame 15 which is mounted on horizontal supports 22 (see FIG. 3) which are attached to the frame of the vehicle 1. The vehicle body protector or guard means protects the body 2 of the vehicle from damage by such as an over active captured animal. A main gate means including a main gate end wing 11, a main gate rear wing 12 and a main gate front wing 13 are all pivotally joined to form an animal capturing area when in the operational position. When the device is in the operational position an arch 4 is Pivotally connected to the main gate means by a hinge or pivot support 26 and to the guard frame means 15 by arch pivot hinge 23 to support the main gate means. A protector guard to protect the animal is usually vertically mounted on the front wing 13 and is generally made of expanded metal. A head gate assembly 5 is mounted on the front bumper 29 of vehicle 1 and comprises a head gate frame 7 bolted or otherwise attached to bumper 29. A head gate post 8 is received by head gate frame 7 at two or more locations and held in the operative position by a locating pin 41 passing through head gate frame 7 and head gate guard post 8 in the top location. To place the head gate 5 in the inoperative position the fluid operated cylinder and piston 6 is disconnected from pivot lever 10 and the head gate arm 9 is rotated about head gate post 8 so that it lies adjacent to guard frame means 15. The locating pin 41 is now placed in another of the locations to hold the gate arm 9 in a stored position. Two holes could be provided in head gate post 8 at the same location. The gate arm 9 is pivotally and rotatably connected to head gate post 8 at the upper end. The head gate arm 9 is generally formed of a curved sometimes reinforced pipe which may have two side straps 30 engaging the outer circumference of the lower portion of head gate post 8. The fluid operated cylinder and piston 6 is pivotally connected at one end to head gate frame 7 and at the opposite end to head gate pivot lever 10 which is fixed to head gate arm 9. The fluid cylinder and piston 6 holds the head gate arm in a raised position until an animal has been captured at which time the operator of the vehicle 1 from inside the vehicle body actuates the fluid cylinder and piston 6 to pivotally lower it and encircle the animals neck thereby restraining the animal. The body guard frame means 15 is also shown connected to the head gate assembly 5 for added strength and rigidity.

Figure 2:
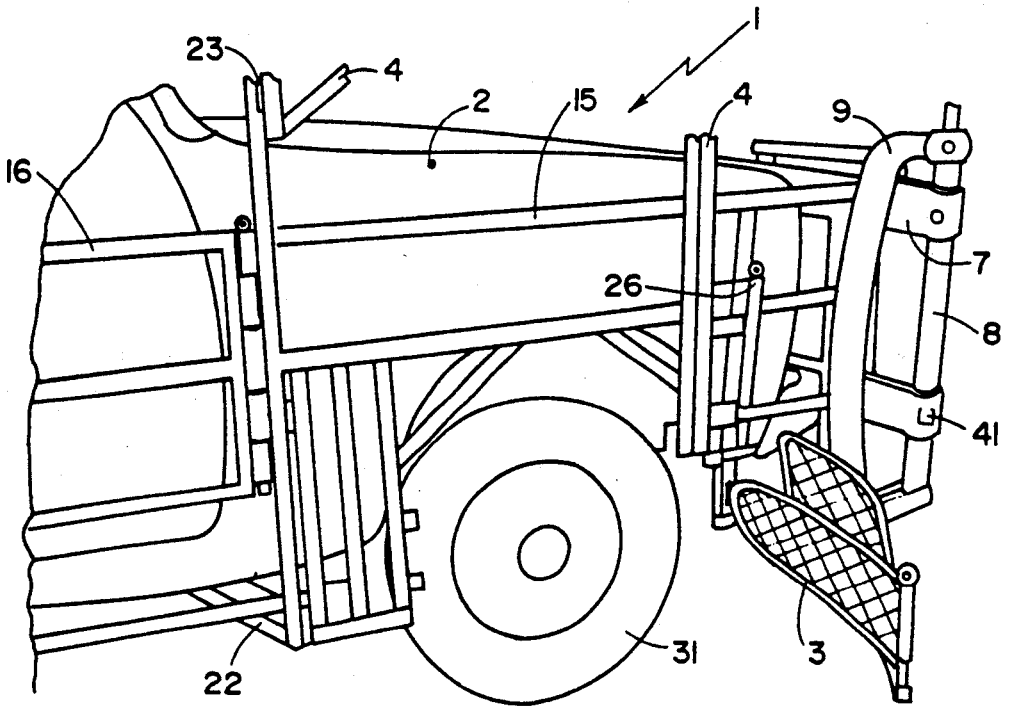
FIG. 2 is a forward end portion in elevation of the mounted invention in the storage position with the wheel guard in the wheel access position.

Referring now to FIG. 2 there is shown mounted on the forward most portion of vehicle 1, the instant invention which includes horizontal supports 22 connected to the frame of the vehicle 1. Supported next to vehicle body 2 for its protection is body guard means formed in part by a body guard frame 15 and in part by a door gate 16 pivotally mounted on body guard frame 15. Shown in part in the stored position against vehicle body 2 is arch 4 with its hinge pivot 23 and its wing pivot support 26. The head gate arm 9 is shown in the stored or inoperative position adjacent the body guard frame 15 supported by the head gate post 8 and head gate frame 7 and secured from rotation by locating pin 41. The wheel guard 3 is shown in the pivoted open position making the vehicle front wheel 31 more accessible for removal or repair. Now viewing in FIG. 3 a more central portion of vehicle 1, there again is shown horizontal supports 22 mounted on the vehicle frame and supporting adjacent the vehicle body 2, body guard means including a body guard frame 15 and a pivotal door gate 16. The door gate 16 ensures a fully useable passenger door 32. The door gate 16 is pivotally mounted to body guard frame 15 and controlled upon opening of the passenger door 32 by door gate guide 21 which is fastened to the passenger door 32. Again as in FIG. 2 a pivotal arch 4 is more fully shown in its stored position with its hinge pivot 23 and wing pivot support 26. The wheel guard 3 has been closed and locked in position while the head gate arm is pivoted against guard frame 15 in the stored position. An upright support 17 is generally placed in the cargo portion of the vehicle body 2 and is fastened at a lowermost portion to the vehicle frame. From the uppermost portion of the upright support 17 a guy extends and is fastened to the guard frame 15 for stability. Between the guard frame 15 and arch 4 is operationally mounted a fluid piston and cylinder 25 operated from within the vehicle body 2 and capable of pivoting arch 4 from a stored position to an operational position supporting the main gate means. The arch 4 when pivotally connected to the main gate means can be pivoted when an animal has been captured thereby restricting the animals ability to move or to accommodate various sizes of animals. A portion of main gate end wing 11 is shown pivotally connected to guard frame 15 and in the stored position against the cargo box of vehicle body 2 is almost entirely concealed by main gate front wing 13. To prevent the main gate front wing 13 from moving away from the vehicle body 2 in the stored position there are provided gate securing pins 42 received in pin apertures 43 pinning together main gate end wing 11 and main gate front wing 13.

Figure 4:
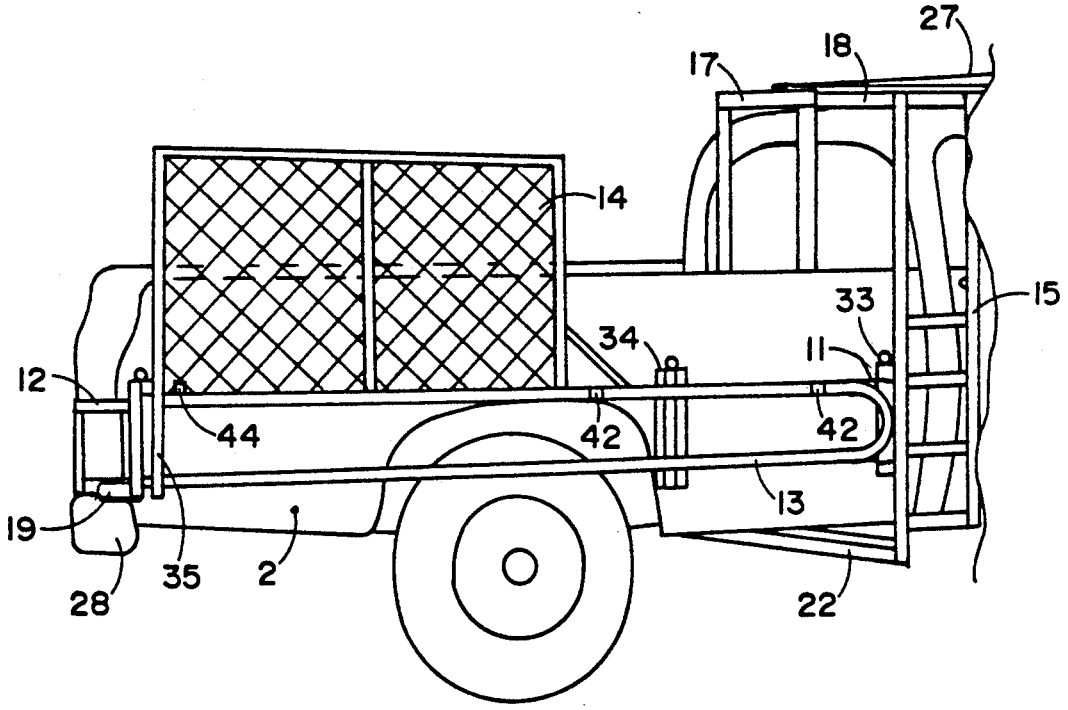
FIG. 4 is a rearward end portion in elevation of the mounted invention in the storage position with the main gate means being supported on the rear bumper.
Figure 5:
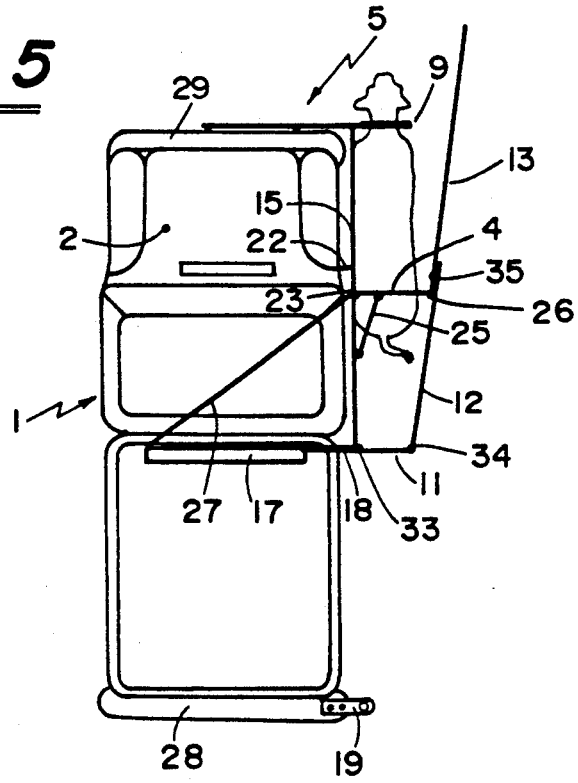
FIG. 5 is a top plan view of the instant invention in the operational position.

Referring now to FIG. 4 there is shown primarily the main gate means in the stored position. The main gate end wing 11 is pivotally mounted to the guard frame 15 by a first pivot joint 33, the main gate end wing 11 is pivotally connected to main gate rear wing 12 by a second pivot joint 34. The main gate rear wing 12 is mostly concealed by main gate front wing 13 but extends therebeyond where it is supported by a rear bumper bracket support 19 fastened to rear bumper 28. Main gate rear wing 12 is pivotally connected to main gate front wing 13 by a third pivot joint 35. A protector guard 14 is generally mounted vertically on main gate front wing 13 and is generally formed of a framework with a screen of expanded metal to protect the animal from injury and to provide for a better confinement, FIG. 5 is a schematic plan view showing the capture and restraint device in a fully operational position with an animal in place. The hinged main gate means 11, 12 and 13 forms an animal capture area and is hingedly supported by guard frame 15 at first pivot joint 33, the guard frame 15 being supported by lateral or horizontal supports 22 attached to the vehicle frame. An arch 4 is pivotally mounted to guard frame 15 at arch hinge pivot 23 and supports the main gate means 11, 12 and 13 with the arch wing pivot support 26. A hydraulic motor or arch cylinder and piston assembly 25 is pivotally connected to the guard frame 15 and arch 4 for controlling the movement of the main gate means 11, 12 and 13. There is an upright 17 generally connected to the vehicle frame in the vehicle cargo box from which a guy is connected to an upper portion of the guard frame 15 and from which a tie bar 18 is also connected to an upper portion of the guard frame 15. The guy is generally in the form of a flexible tension member with the tie bar generally of the same material as the guard frame 15. An adjustment could be provided for the guy 27 and/or tie bar 18 to ensure the stability and proper location of the vehicle body guard means. The head gate assembly 5 has been mounted to front bumper 29 with the head gate post 8 and head gate arm 9 forming a stanchion to encircle the animals neck for restraint.

Figure 6:
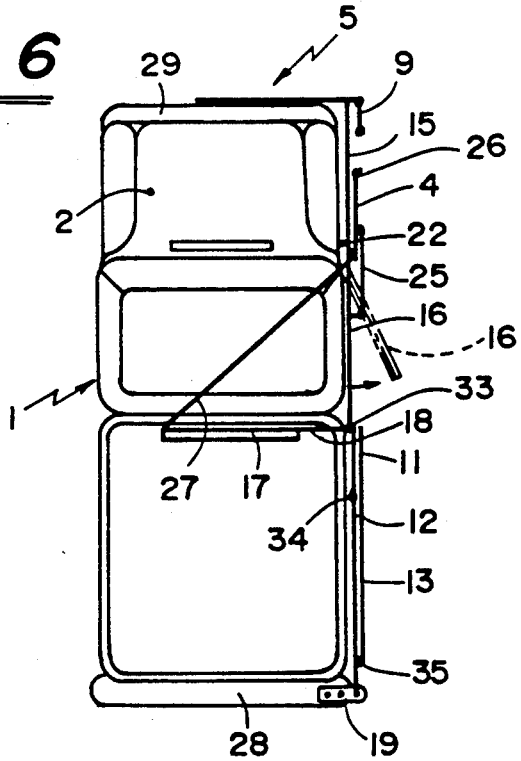
FIG. 6 is a top plan view of the instant invention in the stored position.

FIG. 6 is a further schematic plan view showing the capture and restraint device in the stored or non operational position. The head gate arm 9 has been pivoted rearwardly, the arch 4 has been released at the arch wing pivot support 26 and has been pivoted by fluid power piston cylinder assembly 25 parallel to and adjacent the guard frame 15. The guy 27, upright support 17 and tie bar 18 remain in the operational position. The main gate means 11, 12 and 13 has been folded back and is now adjacent and parallel to the cargo box of vehicle body 2. The main gate means 11, 12 and 13 is supported and held in position by the main gate rear wing 12 engaging rear bumper bracket support 19 fixed to rear bumper 28. The door gate 16 forming with the guard frame 15 the vehicle body guard means, has been shown in the alternate open position.

Now referring to a more detailed view, FIG. 7, of head gate assembly 5 we have a head gate frame 7 which can be bolted or otherwise connected to the front bumper 29. On the head gate frame 7 is pivotally mounted a hydraulic or fluid piston and cylinder assembly 6 which is fed by fluid lines 36 and 37 from a conventional hydraulic pump controlled by the operator of the vehicle 1. The piston and cylinder assembly 6 is pivotally connected to a lever 10 which is fixedly connected to head gate arm $9^1$. The head gate $9^1$ is a variation of head gate 9 with a slightly different reinforced shape. Other shapes are also envisaged. Head gate arm $9^1$ is pivotally mounted to the upper portion of head gate post 8 for forming a stanchion to restrain an animal. Side straps 30 are provided to engage the circumference of head gate post 8 at diametrically opposite points. Locating pin 41 is installed in an upper portion of head gate frame 7 encircling head gate post 8 to hold it stationary. To place head gate arm $9^1$ in the storage position the locating pin is removed, the head gate arm $9^1$ pivoted adjacent body guard frame 15 and the locating pin 41 replaced in a lower portion of head gate frame 7 encircling head gate post 8. Two holes in the same area of head gate post 8 are also envisaged.

A more detailed view of the arch 4 is shown in FIG. 8. The arch 4 is single or double 1¼" square tube or the like. The arch hinge pivot 23 is usually connected to the guard frame 15 above the hinge of vehicle passenger door 32 and the arch wing pivot support 26 supports the main gate means adjacent third pivot joint 35. On the upper portion of arch 4 is an arch hydraulic hinge joint 38 to pivotally receive one end of arch hydraulic cylinder assembly 25.

Now referring to FIG. 9 there is shown the rear bumper bracket support 19 which is adapted to be bolted or otherwise fixed to rear bumper 28. Abutments 39 are usually made of angle iron fixedly mounted on rear bumper bracket support 19 and spaced to receive and prevent lateral displacement of main gate rear wing 12 in the stored position. A winch hook hole is also provided at 40 to accept the hook of a winch to be used during calving to assist in the removal of the calf from the mother.

Figure 10:
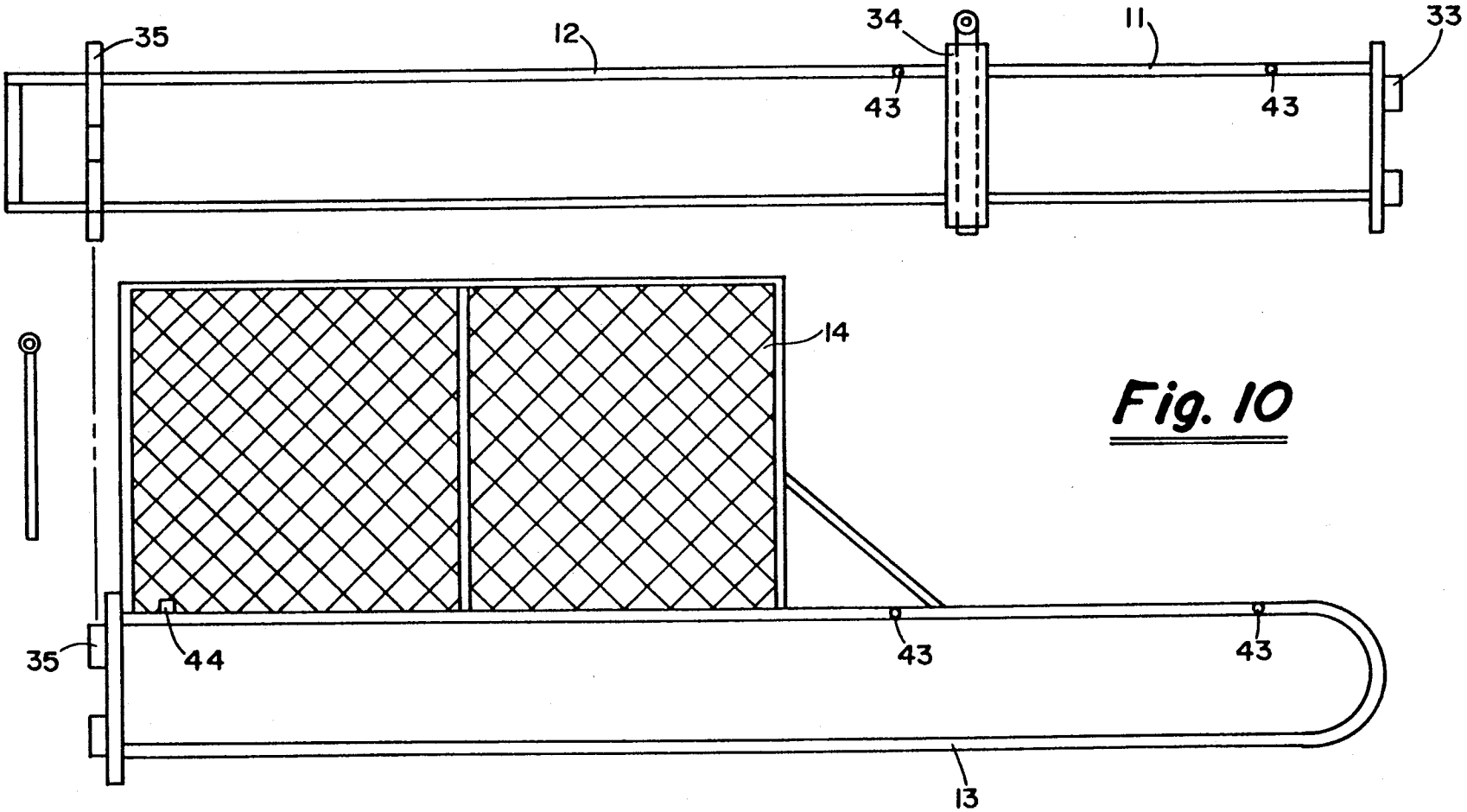
FIG. 10 is a side elevation of separated wing portions of the main gate means.

The FIG. 10 shows the main gate means including a main gate front wing 13 separated from main gate rear wing 12 at third pivot joint 35 for clarity. Main gate front wing 13 carries preferably in a vertical position a mesh generally of expanded metal for protection of the animal and to provide a more confined capture area. First pivot joint 33 attaches the complete main gate means to guard frame 15 as previously indicated in FIGS. 5 and 6. A retainer 44 has also been provided on front gate wing 13 to fasten to gate gear wing 12 in the FIG. 1 position to prevent gate front wing 13 from collapsing inward when the capture area is unoccupied. In the folded or inoperative position gate securing pins 42 pass through corresponding gate securing pin apertures 43.

Various modifications such as size, shape and arrangement of components may be made without departing from the spirit and scope of the invention. The above disclosure shall be interpreted as illustrative only and limited only by the scope of the invention as defined in the following claims.

What I claim is:

1. A capture and restraint device to be mounted on a vehicle having a vehicle frame, a front and a rear bumper and a vehicle body with doors all mounted on said vehicle frame comprising in combination, vehicle mounting means including horizontal support means to be mounted on said vehicle frame, vehicle body guard means including a guard frame, said vehicle body guard means being supported by said horizontal support means, an upright support to be supported by said vehicle frame, a guy connecting said upright support and said guard frame for stabilization thereof, an arch pivotally mounted on said vehicle body guard means, first fluid operated means connecting said guard frame and said arch for controlled pivotal movement thereof, main gate means pivotally mounted to said guard frame and including an end wing, a rear wing and a front wing all pivotally joined, a head gate assembly including a head gate frame for mounting said head gate assembly to said front bumper, a head gate post rotatably mounted in said head gate frame a head gate arm pivotally mounted to said head gate post, second fluid operated means connecting said head gate frame and said head gate arm for controlled pivotal movement thereof, said head gate frame and said guard frame are connected for strength and rigidity whereby an animal can be captured by said main gate means and restrained by said head gate assembly as the vehicle moves forwardly.

2. A capture and restraint device as claimed in claim 1 further including a door gate protecting one of said doors and formed from a pivotal portion of said body guard means to permit opening of said protected door.

3. A capture and restraint device as claimed in claim 2 further including a protector guard mounted on said main gate means.

4. A capture and restraint device as claimed in claim 3 further including a wheel guard pivotally mounted to said guard frame.

5. A capture and restraint device as claimed in claim 4 further including a door gate guide to be mounted on said protected door for controlling door gate movement upon operation thereof.

6. A capture and restraint device as claimed in claim 4 further including a tie bar connecting said guard frame to said upright for stabilization of said guard frame.

7. A capture and restraint device as claimed in claim 6 further including a rear bumper bracket support to be mounted on said rear bumper for supporting said main gate means when folded in a stored position adjacent said vehicle body.

8. A capture and restraint device to be mounted on a vehicle having a vehicle frame, a front and a rear bumper and a vehicle body with doors, all mounted on said vehicle frame comprising in combination, vehicle mounting means adapted to be connected to said vehicle along one side thereof, vehicle body guard means connected to said vehicle mounting means, main gate means supported by said vehicle body guard means to form therewith an animal capturing area, and animal restraining means cooperating with said vehicle body guard means and adapted to be connected to said vehicle frame, whereby said capture and restraint device, fully supported by said vehicle, can be used to catch an animal while stationary or moving.

9. A capture and restraint device as claimed in claim 8 wherein said vehicle body guard means includes a guard frame and a pivotal portion.

10. A capture and restraint device as claimed in claim 9 further including guide means adapted to be mounted on said vehicle body and control movement of said pivotal portion of said body guard means.

11. A capture and restraint device as claimed in claim 8 wherein said main gate means includes at least two pivotally connected wings.

12. A capture and restraint device as claimed in claim 11 further including a protector guard on at least one of said pivotally connected wings.

13. A capture and restraint system as claimed in claim 12 wherein said protector guard is vertically mounted on one of said pivotally connected wings nearest said front bumper.

14. A capture and restraint device as claimed in claim 8 further including arch means pivotally connected to said vehicle body guard means and to said main gate means when operational.

15. A capture and restraint device as claimed in claim 14 further including arch support means adapted to be connected to said vehicle frame and to said arch means.

16. A capture and restraint device as claimed in claim 15 wherein said arch support means includes an upright support means and guy means.

17. A capture and restraint device as claimed in claim 16 further including tie bar means connected to said upright support means and to said vehicle body guard means for stabilization of said body guard means.

18. A capture and restraint device as claimed in claim 14 further including an arch power operating means pivotally connected to said vehicle body guard means and to said arch means to pivot said arch means to decrease or increase said animal capturing area.

19. A capture and restraint device as claimed in claim 8 wherein said animal restraining means is in the form of a head gate assembly including a head gate frame adapted to be mounted on said front bumper, a head gate post mounted on said head gate frame, a head gate arm pivotally mounted on said head gate post and a head gate power operating means to pivot said head gate arm on demand.

20. A capture and restraint device as claimed in claim 8 wherein said body guard means includes a guard frame and a pivotal portion, wherein said main gate means includes at least two pivotally connected wings, and further including arch means pivotally connected to said vehicle body guard means and to said main gate means when operational.

21. A capture and restraint means as claimed in claim 20 wherein said animal restraining means is in the form of a head gate assembly.

* * * * *